US005282453A

United States Patent [19]

Chia

[11] Patent Number: 5,282,453

[45] Date of Patent: Feb. 1, 1994

[54] TOY SLINGSHOT DEVICE FOR LAUNCHING A PROJECTILE

[76] Inventor: Francis Chia, 17 Kadoorie Avenue, Kowloon, Hong Kong

[21] Appl. No.: 980,345

[22] Filed: Nov. 23, 1992

[51] Int. Cl.[5] ..... F41B 7/00

[52] U.S. Cl. ..... 124/20.1; 124/20.3; 124/20.2

[58] Field of Search ..... 124/20.1, 20.2, 20.3

[56] References Cited

U.S. PATENT DOCUMENTS

| | | | |
|---|---|---|---|
| 844,665 | 2/1907 | Dills | 124/20.1 |
| 876,324 | 1/1908 | Brucker . | |
| 1,468,223 | 9/1923 | Baltich . | |
| 2,244,342 | 6/1941 | Mahlck . | |
| 3,071,127 | 1/1963 | Spack . | |
| 3,085,560 | 4/1963 | Peters . | |
| 3,099,256 | 7/1963 | Halverson | 124/20.3 |
| 3,126,880 | 3/1964 | Loe . | |
| 3,496,671 | 2/1970 | Korona . | |
| 3,614,947 | 10/1971 | Feldman . | |
| 3,728,996 | 4/1973 | Miller | 124/20.3 |
| 3,905,350 | 9/1975 | Becker . | |
| 3,918,427 | 11/1975 | Turner | 124/20.3 |
| 4,332,230 | 6/1982 | Lozier . | |

*Primary Examiner*—Randolph A. Reese
*Assistant Examiner*—John Ricci
*Attorney, Agent, or Firm*—Samuelson & Jacob

[57] ABSTRACT

A slingshot device includes a missile and a launcher for launching the missile, the launcher including a handle adapted to be grasped by a user, an elastic strap for projecting the missile, the elastic strap having a first end connected with the handle and a second free end, a launching wedge affixed to the free end of the strap for releasably coupling the free end of the elastic strap with the missile such that upon drawing the free end back away from the handle and then releasing the free end the missile is accelerated forward and launched beyond the handle, and a somewhat flexible control tube connected to the handle for restraining any uncontrolled whipping about of the elastic strap and essentially precluding travel of the free end of the elastic strap forward beyond the handle, the control tube essentially surrounding at least a portion of the length of the elastic strap so that the elastic strap is retracted within the control tube upon launching of the projectile and is precluded from following the projectile beyond the handle.

11 Claims, 2 Drawing Sheets

TOY SLINGSHOT DEVICE FOR LAUNCHING A PROJECTILE

The present invention relates generally to slingshot devices and pertains, more specifically, to a toy slingshot device having safety measures designed to prevent injury to a user and to any bystander in the vicinity.

Slingshot devices for launching projectiles are well-known. One type of slingshot includes a handle with an elastic strap, one end of which is secured to the handle while the other end is free. The user holds the handle and releasably couples a projectile with the free end of the elastic strap. Then, the projectile is pulled back, away from the handle, to stretch the elastic strap. When the projectile is released, the elastic strap returns rapidly from the stretched condition to its relaxed condition, accelerating the projectile and launching the projectile forward beyond the handle.

However, for a number of reasons, toy manufacturers have been reluctant to produce slingshot devices for children. One reason is that after the elastic strap is released and the projectile is launched, the elastic strap itself has a tendency to whip about, and especially to travel forward beyond the handle, presenting a hazard in that the free end of the elastic strap becomes free to strike another child in the vicinity, in the eye or another part of the body, causing injury to the other child. In addition, children are tempted to use a slingshot device to launch dangerous objects, such as pebbles, rocks, or paper clips and the like, such use being especially attractive where a hook or some other readily coupled launching arrangement is made available at the free end of the elastic strap.

The present invention provides a slingshot device which avoids many of the problems encountered in the above-outlined slingshot devices and exhibits several objects and advantages, some of which may be summarized as follows. First, the use of a somewhat flexible control tube surrounding the elastic band so as to enable retraction of the elastic band into the control tube upon the launching of a projectile prevents uncontrolled whipping about of the elastic strap, and especially precludes the elastic strap from travelling forward beyond the handle, during the launching operation, while still providing sufficient flexibility so as not to impede the launching operation. Second, the use of layers of closely sewn together elastic material to form the elastic strap provides an appropriate and effective integrated elastic component, while assuring that no open loops are available at the free end of the elastic strap for coupling an unauthorized object, such as a pebble, a rock or a paper clip, for launching. Further assurance against the coupling of such an unauthorized object with the elastic strap is provided by a specific coupling arrangement in which a launching wedge is affixed at the free end of the elastic strap, the configuration of the launching wedge being such that a child is precluded from hooking or otherwise coupling an unauthorized object, such as a paper clip, onto the elastic strap.

The above objects and advantages, as well as further objects and advantages, are attained by the present invention which may be described briefly as improvements in a slingshot device of the type including a projectile to be launched, the projectile having an engagement device, and a launcher for launching the projectile, the launcher including a handle for being grasped by a user, an elastic strap for launching the projectile, the elastic strap having a first end affixed to the handle and a second end free to move relative to the handle, a releasable attachment for releasably coupling the free end of the elastic strap to the engagement device of the projectile such that drawing the free end rearward away from the handle to extend the elastic strap from a relaxed condition to a stretched condition and then releasing the free end to enable relatively rapid contraction of the elastic strap from the stretched condition to the relaxed condition causes the projectile to be accelerated forward and launched beyond the handle, and a generally tubular member for essentially preventing movement of the free end of the elastic strap forward of the handle, the tubular member essentially surrounding at least a portion of the elastic strap so that the elastic strap retracts into the tubular member upon contraction of the elastic strap and launching of the projectile and is precluded from following the projectile beyond the handle. Preferably, the tubular member has one end affixed to the handle and is constructed of a somewhat flexible material so as not to impede the launching operation. The elastic strap preferably is constructed of a plurality of superposed layers of elastic material sewn together to effectively form an integrated elastic component.

The releasable attachment includes a launching wedge fixed to the free end of the elastic strap, and the engagement device includes an engagement track for receiving a portion of the launching wedge. More specifically, the projectile is a missile having an elongate cylindrical body constructed of a soft foamed synthetic polymeric material, and the engagement track includes a substantially U-shaped retainer fixed to an outer surface of the cylindrical body for receiving a portion of the launching wedge. The substantially U-shaped retainer also includes outer flanges for securing the launching wedge against release in a direction extending radially from the cylindrical body.

The invention will be understood more fully, while still further objects and advantages will become apparent, in the following detailed description of a preferred embodiment of the invention illustrated in the accompanying drawing, in which.

Figure 1:
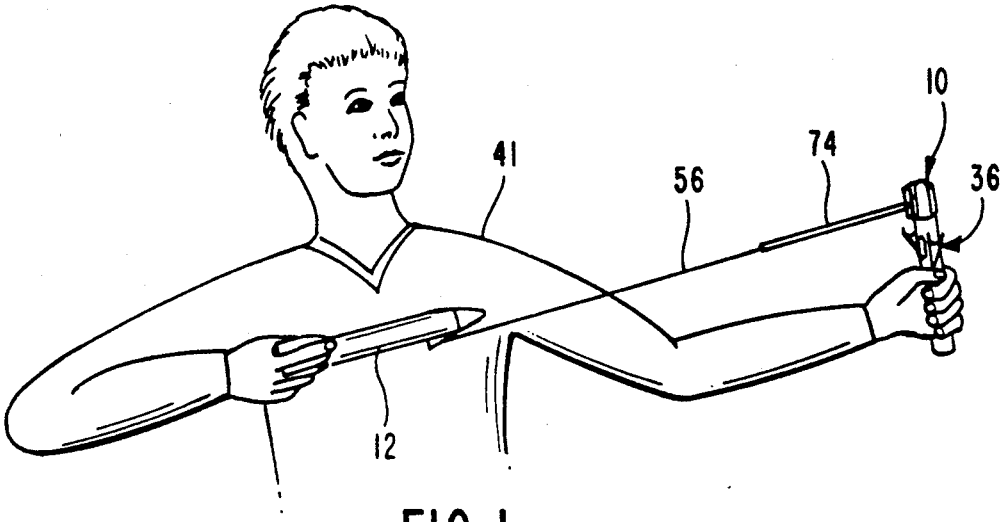
FIG. 1 is a perspective view showing use by a child of the slingshot device according to the present invention.

Referring now to the drawing, a slingshot device constructed in accordance with the present invention is illustrated generally at 10. Slingshot device 10 includes at least one projectile in the form of a missile 12 to be launched. Missile 12 has an elongate cylindrical body 14 including a front end in the form of an essentially conical tip 16. For safety purposes, cylindrical body 14 and conical tip 16 preferably are formed as a unitary structure made from a soft foamed synthetic polymeric material, such as an expanded polyethylene In order to increase aerial stability, three fins 18 are secured equiangularly about the outer surface of cylindrical body 14 adjacent the rear end of the cylindrical body 14, each fin 18 extending in the axial direction and projecting radially from cylindrical body 14. Fins 18 also preferably are made of a soft foamed synthetic polymeric material, such as an expanded polyethylene or the like.

A coupling means in the form of a rigid engagement track 20 is located on the outer surface of cylindrical body 14, immediately rearward of conical tip 16. Engagement track 20 includes a substantially U-shaped retainer 22 secured to the outer surface of cylindrical body 14. Specifically, substantially U-shaped retainer 22 includes a bottom wall 24 which is secured on the outer surface of cylindrical body, and parallel, spaced apart side walls 26 and 28 connected to and extending outwardly from opposite sides of bottom wall 24 so as to be substantially perpendicular to bottom wall 24. The upper free ends of side walls 26 and 28 have inwardly turned retaining flanges 30 and 32, respectively, which extend toward each other. A gap 34 is defined between the free ends of flanges 30 and 32.

Slingshot device 10 further includes a launcher 36 for launching missile 12. Launcher 36 includes a handle 38 having a lower grasping section 40 adapted to be grasped by a user 41, as shown in FIG. 1, and an upper securement housing 42, which will be described in greater detail hereinafter. Grasping section 40 includes a generally cylindrical body 44, preferably molded of a durable plastic material. Two substantially semi-circular holders 46 are secured to opposite sides at the upper portion of cylindrical body 44, each having a diameter slightly smaller than corresponding portions of the cylindrical body 14 of missile 12 for releasably holding two missiles 12 clipped to the body 44 at storage locations, as depicted in phantom in FIG. 2.

Upper securement housing 42 is connected to the upper end of lower grasping section 40 and is formed of two half shells 48 and 50 which establish an internal cavity 52 when secured together. Half shells 48 and 50 can be secured together by any suitable means. For example, a bolt (not shown) can be inserted within an opening 54 in one half shell 48 and threadedly engaged within a threaded opening (not shown) in the other half shell 48. It will be appreciated that grasping section 40 can be formed in a similar manner so that a lip (not shown) at the upper edge of grasping section 40 can engage a lower flange (not shown) of securement housing 42 for connecting securement housing 42 to grasping section 40.

Launcher 36 also includes an elongate elastic strap 56 which preferably is made up of a plurality of layers 58 of elastic material bound together, as by sewing, to provide the desired elastic characteristics in elastic strap 56. It is noted that layers 58, when so bound together, effectively form one integrated elastic component, such that no opening is available in the elastic strap 56 for a child to insert or otherwise couple an unauthorized object, such as a pebble, a rock, a paper clip or the like, with the elastic strap for launching.

One end of elastic strap 56 is secured to securement housing 42 in any suitable manner. As one example of such a securement, half shell 48 can be formed with two parallel, spaced apart walls 60, each having a U-shaped recess 62 at its free end. A pin 64 is held within recesses 62. In order to prevent escape of pin 64, restraining walls 66 are provided in the other half shell 50, with restraining walls 66 functioning to close recesses 62. Thus, pin 64 is captured within the confines of recesses 62. With such an arrangement, one end of elastic strap 56 extends through an opening 68 of half shell 48, and pin 64 extends through the one end of elastic strap 56 so as to hold that end within cavity 52 of securement housing 42.

In accordance with one aspect of the present invention, further coupling means, shown in the form of a flat launching wedge 70, is fixed to the free end of elastic strap 56 such that no freely engaged loop is available in elastic strap 56. For example, a tight link 72 is formed at the free end of elastic strap 56 for attaching and securing launching wedge 70 to the elastic strap 56. In that case, link 72 is strongly secured to the upper and lower surfaces of launching wedge 70, as by stitching or with an adhesive, and launching wedge 70 is dimensioned to fit snugly within link 72, so that a child cannot couple any unauthorized object, such as a pebble, a rock or a paper clip, to the elastic strap 56 for launching.

Figure 5:
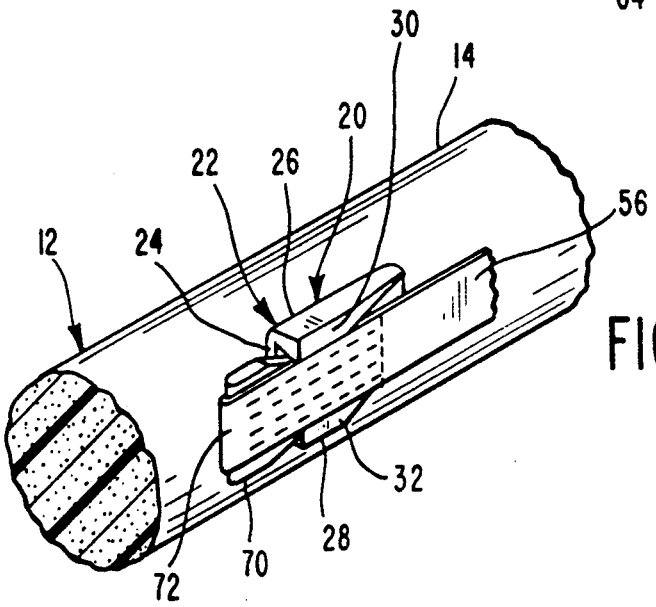
FIG. 5 is an enlarged view of a portion of the missile releasably connected with the launching wedge of the launcher.

It will be appreciated that launching wedge 70 is configured and dimensioned, as shown in FIG. 5, to wedge into the rear open end of U-shaped retainer 22 of engagement track 20 during the launching operation. In such case, retaining flanges 30 and 32 secure launching wedge 70 against movement in a direction extending radially from the cylindrical body 14 of the missile 12, thereby preventing escape of launching wedge 70 from U-shaped retainer 22 in the radial direction.

Figure 2:
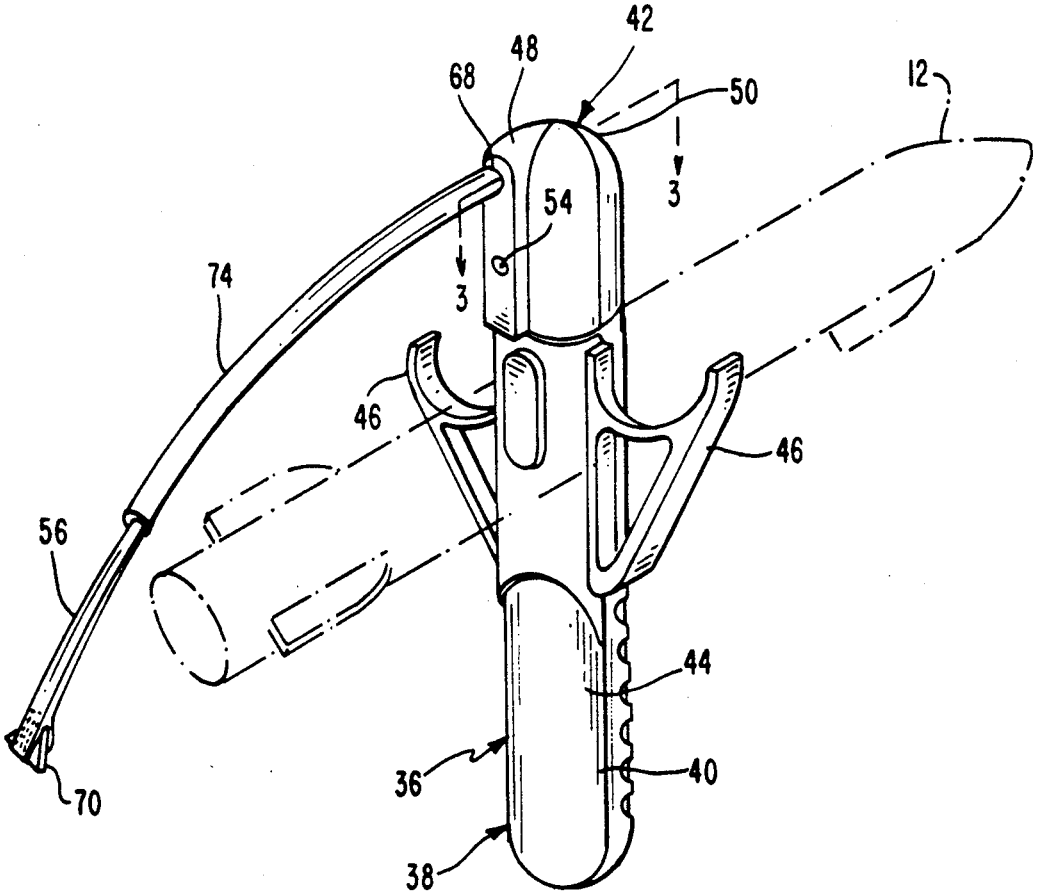
FIG. 2 is a perspective view of the launcher of the slingshot device of FIG. 1, with one missile shown in phantom in a storage position on the launcher.
Figure 4:
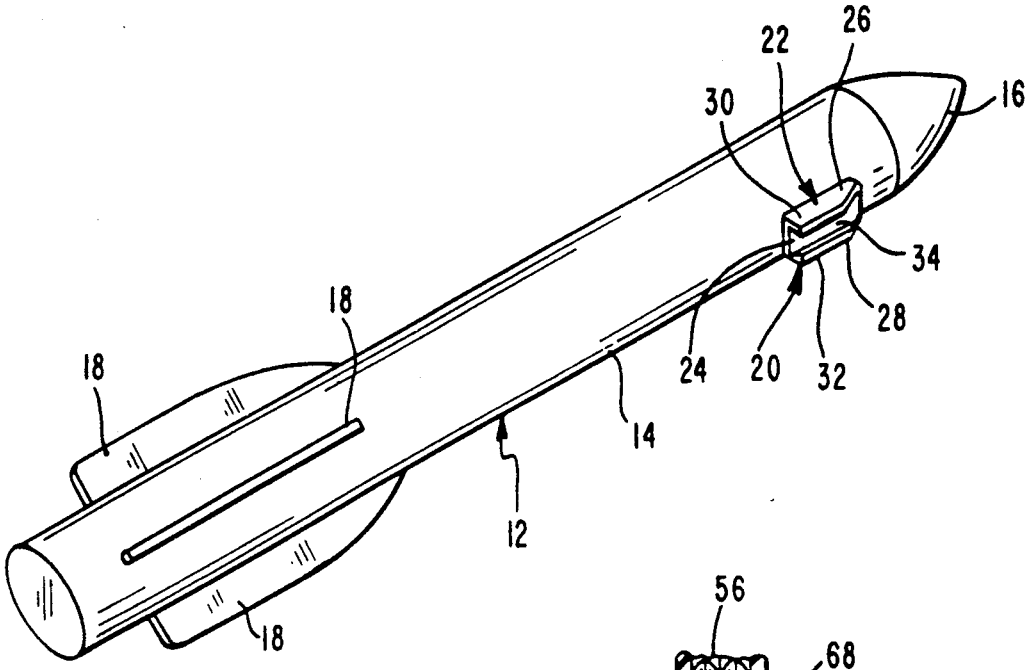
FIG. 4 is a perspective view of a missile of the slingshot device of FIG. 1.

With the aforementioned arrangement, the user 41 grasps cylindrical body 44 of handle 38 at a position below semi-circular missile holders 46, with one hand. With the other hand, the user inserts launching wedge 70 partially through the rear open end of U-shaped retainer 22 such that launching wedge 70 and U-shaped retainer 22 function as a releasable coupling between the elastic strap 56 and the missile 12. Then, the user pulls rearward on missile 12, that is, back away from handle 38, drawing the missile 12 back and extending the elastic strap 56 from a relaxed condition, as seen in FIG. 2,. toward a stretched condition, as illustrated in FIG. 1, until a desired stretch is attained in elastic strap 56. The missile 12 subsequently is released, freeing the elastic strap 56 for contraction and return to the relaxed condition. Upon releasing missile 12, elastic strap 56 contracts rapidly, accelerating missile 12 and flinging the missile 12 forward of handle 38 to launch the missile 12 beyond the handle 38 with a force determined by the aforementioned rearward stretch of elastic strap 56.

However, as discussed above, with conventional slingshot devices, after the elastic strap is released, the elastic strap has a tendency to whip about in an uncontrolled manner, and especially to travel forwardly of the handle. Such uncontrolled movement is dangerous since the free end of the elastic strap could strike another child, in the eye or elsewhere, causing injury to the other child. Therefore, in accordance with another aspect of the present invention, a restraining means in the form of a restraining control tube 74 is provided for restraining uncontrolled movement of the elastic strap 56 and essentially precluding movement of the free end of elastic strap 56 forward beyond the handle 38. More specifically, control tube 74 extends rearward from the securement housing 42 and is arranged so as to surround at least a portion of elastic strap 56. In a preferred arrangement, control tube 74 extends along approximately four-fifths of the length of elastic strap 56 when the elastic strap 56 is in the relaxed condition and is retracted into the tube 74. Control tube 74 can be made of any suitable material which retains its shape in the absence of an external force, but which is somewhat flexible when bent by a user during a launching operation so as not to impede the launching operation. For example, control tube 74 can be made of a synthetic polymeric material, such as PVC (polyvinyl chloride).

Figure 3:
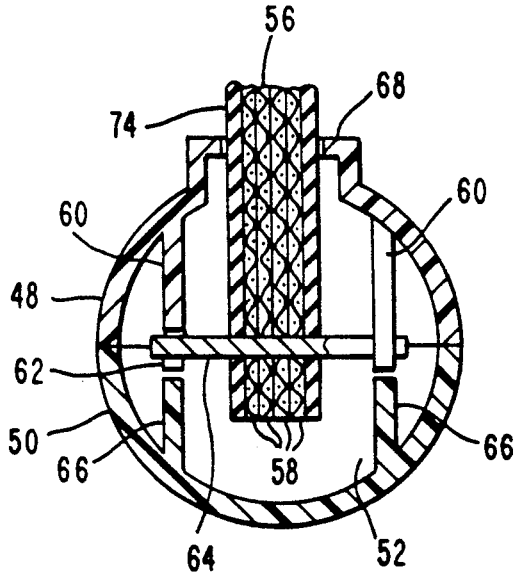
FIG. 3 is a cross-sectional view of the slingshot device of FIG. 1, taken along line 3—3 thereof.

The forward end of restraining control tube 74 preferably is fixed relative to the forward end of elastic strap 56. One example for obtaining such arrangement is shown in FIG. 3 in which control tube 74 extends, in surrounding relation, through opening 68, and pin 64 also extends through the forward end of control tube 74 to affix this end within securement housing 42. However, the present invention is not so limited with respect to the attachment of control tube 74. For example, restraining control tube 74 can be secured to elastic strap 56, or even can be arranged on elastic strap 56 so as to prevent sliding movement without the control tube 74 being secured to elastic strap 56 or securement housing 42.

Thus, elastic strap 56, when pulled rearward to the stretched condition, extends well beyond control tube 74. After the free end of elastic strap 56 is released in the launching operation, elastic strap 56 contracts, due to its elastic nature, and returns rapidly to the relaxed condition. However, because of the surrounding arrangement of control tube 74, elastic strap 56 returns to the position shown in FIG. 2, retracted within control tube 74. In this manner, control tube 74 exerts control over unwanted movements of the elastic strap 56, and essentially prevents movement of elastic strap 56 forwardly of handle 38, without impeding the launching operation. Thus, a child can safely use slingshot device 10 without fear of injury to himself or to anyone else in the vicinity.

It is to be understood that the above detailed description of a preferred embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. In a slingshot device of the type in which a projectile is launched by a launching means, the improvement in which the launching means comprises:

handle means for being grasped by a user;

elastic strap means for launching said projectile, said elastic strap means having a first end affixed to said handle means and a second end free to move relative to the handle;

releasable means for releasably coupling said free end of said elastic strap means to said projectile such that drawing said free end rearward away from said handle means to extend the elastic strap from a relaxed condition to a stretched condition and then releasing said free end to enable relatively rapid contraction of the elastic strap from the stretched condition to the relaxed condition causes said projectile to be accelerated forward and launched beyond said handle means; and restraining means for controlling movement of said elastic strap means so as essentially to preclude forward movement of the free end of the elastic strap means beyond said handle, said restraining means surrounding at least a portion of said elastic strap means when the strap means is in the relaxed condition so that the elastic strap means retracts into the restraining means upon launching of the projectile for precluding the free end of the elastic strap means from following the projectile beyond the handle.

2. The invention of claim 1, wherein said restraining means comprises a tubular member having one end connected with said handle means.

3. The invention of claim 2, wherein said tubular member extends rearward from said handle means.

4. The invention of claim 2, wherein said tubular member is somewhat flexible so as not to impede launching of the projectile.

5. The invention of claim 1, wherein said elastic strap means is made from a plurality of superposed layers of elastic material bound together to effectively form an integrated elastic component.

6. The invention of claim 1, wherein said releasable means includes first coupling means at the free end of said elastic strap means, and second coupling means on the projectile, the first and second coupling means having complementary configurations for deterring any coupling of the elastic strap means with an object other than a projectile bearing said second coupling means.

7. The invention of claim 6, wherein the first coupling means includes a launching wedge affixed to the free end of the elastic strap means, and the second coupling means includes track means complementary to the launching wedge for receiving at least a portion of the launching wedge in coupled engagement with the track means.

8. The invention of claim 7, wherein said projectile is a missile having an elongate cylindrical body including an outer surface, and said track means includes substantially U-shaped retainer means fixed to the outer surface of said cylindrical body for receiving said portion of said launching wedge.

9. The invention of claim 8, wherein said substantially U-shaped retainer means includes outer flange means for securing said launching wedge against movement in a radial direction relative to said cylindrical body.

10. The invention of claim 1, including the improvement wherein said projectile is a missile having an elongate cylindrical body including an outer surface extending between opposite ends, an essentially conical tip at one of said opposite ends, and a plurality of fins mounted on the outer surface of said cylindrical body adjacent the other of said opposite ends.

11. The invention of claim 10, wherein said missile is constructed of a soft foamed synthetic polymeric material.

* * * * *